United States Patent [19]

Metzdorf

[11] Patent Number: 4,498,323

[45] Date of Patent: Feb. 12, 1985

[54] METHOD OF ROLLING SHEET PILING

[75] Inventor: Jacques Metzdorf, Esch/Alzette, Luxembourg

[73] Assignee: Arbed S.A., Luxembourg, Luxembourg

[21] Appl. No.: 426,064

[22] Filed: Sep. 28, 1982

[30] Foreign Application Priority Data

May 25, 1982 [LU] Luxembourg ..... 84169

[51] Int. Cl.[3] ..... B21B 1/08

[52] U.S. Cl. ..... 72/177; 72/225; 72/234; 72/366

[58] Field of Search ..... 72/234, 225, 366, 226, 72/177, 181

[56] References Cited

U.S. PATENT DOCUMENTS 2,371,671 3/1945 Blount et al. ..... 72/366

4,334,419 6/1982 Kishikawa et al. ..... 72/234 X

FOREIGN PATENT DOCUMENTS 158803 12/1980 Japan ..... 72/234

2018656A 10/1979 United Kingdom .

2037205A 7/1980 United Kingdom .

*Primary Examiner*—Francis S. Husar

*Assistant Examiner*—Steven B. Katz

*Attorney, Agent, or Firm*—Karl F. Ross; Herbert Dubno

[57] ABSTRACT

In an eleven-step butterfly rolling process for producing inertial sheet piling, the upset grooving hitherto used in the fourth step is eliminated and replaced by one or more flat rolling steps intended to work the bulges at the edges of the flanges so as to impart a grain structure parallel to the flat rolled surfaces and thereby avoid cracking after the edge portion has been bent into hook configuration.

5 Claims, 9 Drawing Figures

PRIOR ART

METHOD OF ROLLING SHEET PILING

FIELD OF THE INVENTION

My present invention relates to a method of rolling sheet piling and, more particularly, to a method of rolling so-called sheet piles having hook-shaped edges adapted to interlock with one another.

BACKGROUND OF THE INVENTION

Inertial sheet piling is formed by interlocking hook-shaped edges of U-shaped or channel piles each of which is formed with a generally flat web, a pair of flanges diverging from this web and defining the U-section with the web, and a pair of outwardly turned hooks along the free edges of these flanges. The hooks or bends are shaped so that the piles can interengage in the manner described.

Sheet piling of this type is generally rolled from steel and the principles of rolling steel sections having flanges or flangelike portions will be apparent from U.S. Pat. No. 4,334,419, for example, and the references cited therein and in the same class of the *Manual of Patent Classification.*

Sheet piling of the aforedescribed type is generally driven into the ground to form a wall, curtain or other ground- or water-retaining structure, e.g. coffer dams, enabling excavation, for example, on one side of this wall.

The sheet piles are usually driven into place by vibratory or hammer-type pile drivers and are interlocked in the manner described during the driving operation.

Two different types of sheet piling can be distinguished. For example, flat sheet piling utilizes a cellular structure having high resistance to traction and design, for example, so that the hooks at which the sheet piling interlocks, are capable of withstanding traction forces of the order of metric tons per meter of length of the hooks.

Inertial piling of the type with which the invention is concerned is commonly subjected to transverse forces which change in direction and thus must be capable of use in walls to withstand flexion.

The predominant qualitative characteristic, therefore, must be a high module of flexion and hence the gripping edges of the sheet piles must be capable of retaining their anchorage even when faced with repeated distortions in various directions.

In practice, it is found that the hook-shaped edges of conventionally fabricated inertial sheet piling can develop cracks or fissures which may cause failure of the hook structure and render the piles useless even after they have been emplaced.

This may necessitate removal and replacement of the defective piles and may seriously reduce the useful life of a wall constructed of such sheet piling.

I have now been able to trace the source of these cracks and defects to the method of manufacture of inertial sheet piles hitherto used.

In the past, such sheet piles have been rolled into the final configuration in a total of eleven passes by an approach known in the art as the "butterfly" technique.

In the rolling to produce such sheet piling, the most sensitive or delicate steps are those which are involved in the formation of the gripping or hook edges.

Within the earlier technique, the first three steps of the total of eleven passes are generally cross section reduction and rough-shaping steps in which the bloom is transformed from its rectangular structure into a rough body having the cross section generally of a W, the subsequent eight steps serving to flatten the bight of the U or the web to define the appropriate angle between the flanges and the web, to reduce the cross section of the body further, and to develop the hook-shaped gripping edges on the outer limbs of the flanges.

These hook-shaped formations are developed out of bulges provided along the free edges of the flanges at the third pass.

In the prior art method, after the third pass, these bulges are subjected to a grooving-upsetting operation involving a transverse pinching action which defines, to the outside of the neck formed by the pinching action, a bulge which is later deformed to provide the hook formation.

In practice, this grooving-upsetting fourth pass is followed by a rolling operation which tends to flatten the upset region and is referred to as an open groove rolling, this fifth pass being followed by one or more upsetting passes which extend to the last three passes at which folding of the hook is effected, the last or eleventh pass involving the inward folding of the upper surface of the edge to finally define the hook.

While this method involves numerous rolling steps to define the hook-shaped edges, it also creates the conditions, as I have now discovered, under which cracks or fissures occur primarily at the bend of the hook portion which may lead to failure of the linking of the piles. These fine cracks extend longitudinally and are even visible at the surface of the hook.

OBJECTS OF THE INVENTION

It is the principal object of the present invention to provide an improved method of fabricating inertial sheet piling whereby the disadvantages of the earlier method described can be obviated.

Another object of this invention is to provide improved sheet piling which is less subject to cracking at the hook junctions between the piles.

SUMMARY OF THE INVENTION

I have now discovered, quite surprisingly, that the disadvantages of the prior-art method can be overcome without increasing the number of rolling steps by eliminating the grooving-upsetting or pinching operation previously found to be essential in the prior-art system and effecting prior to folding and instead of the upsetting operations of the prior art at least one and preferably a plurality of flat rolling steps along the edge bulge of the rough-rolled body such that at least the fourth pass and preferably the fourth, fifth and sixth passes are essentially flat rolling operations with possibly the sixth pass imparting an incipient bend to the edge of each flange whereby the hook portions can be formed.

Surprisingly, this approach allows at least one and preferably three flat working steps to be substituted for the upsetting steps of the prior art to generate a grain microstructure or grain fiber orientation within the body whose grain lines or fibers lie parallel to the surface of the hook-shaped end even upon the bending thereof into the hook configuration.

With the upsetting operations of the prior art the fibers at least in part lie perpendicular to the surface of the hook whereas a fiber orientation parallel to the surface of the hook is practically guaranteed with the method of the invention.

At the bend of the hook cracks do not appear, especially if the final bending step is a hot bending of the end of the hook so that the outer surface of the latter is bent inwardly to include an acute angle and preferably an angle of 45° so as to be complementary to the hook of an adjoining sheet pile.

BRIEF DESCRIPTION OF THE DRAWING

The above and other objects, features and advantages of the present invention will become more readily apparent from the following description, reference being made to the accompanying drawing in which.

SPECIFIC DESCRIPTION

Before discussing the prior art method and the method of the invention in greater detail, it should be noted that, in both of the methods illustrated, the first and second steps have been combined. These steps involve the rough rolling of the bloom to form a blank of W configuration which has its size further reduced in the third step. The first three steps of the prior art method, represented at 101–103 are thus basically similar to the first three steps 201–203 of the method of the invention.

Similarly, the last three steps 109–111 of the prior art method are essentially similar to the last three steps 209–211 of the method of the invention.

Furthermore, since both methods use a total of eleven steps, the individual rolling steps have been designated with similar numerals except for the hundreds digits as indicated.

Basically, in the fourth step 104 of the prior art method, the bulge 103*a*, provided on the free edge of the flange 103*b* at each side of the W-section blank is subjected to a combined grooving and upsetting operation by picturing this bulge outwardly of the outer edge thereof as represented by the arrows 104*a* and 104*b*.

Figure 1:
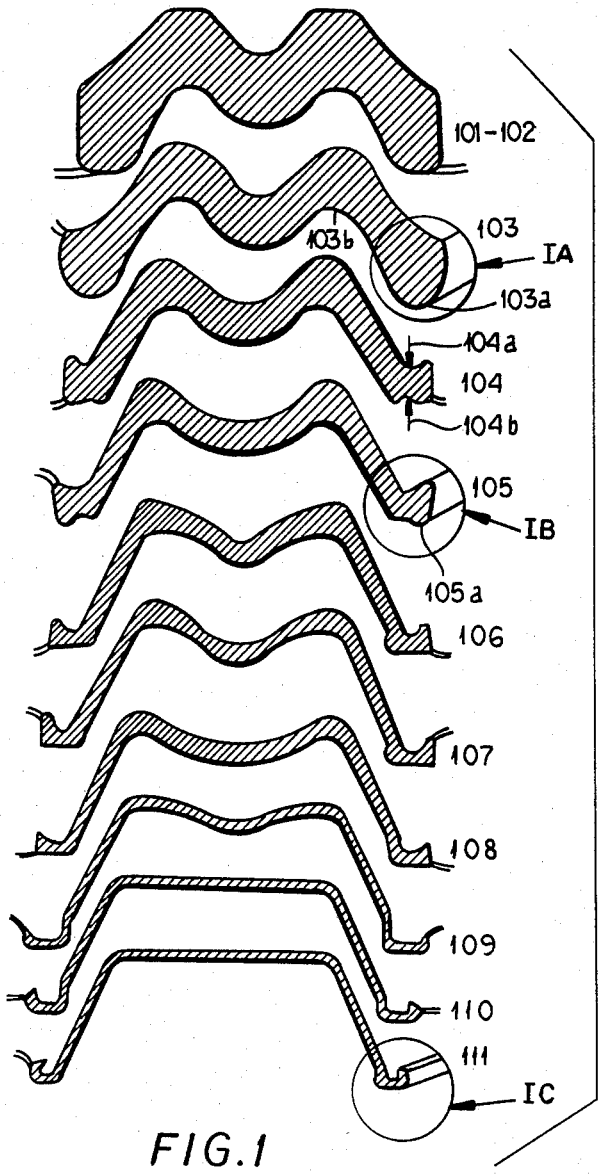
FIG. 1 is a diagram illustrating ten of eleven steps of a conventional rolling method for reducing inertial sheet piling, namely the butterfly method.
Figure 1A:
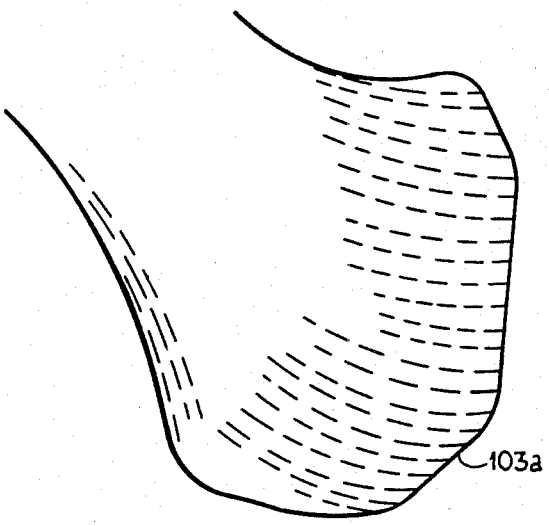
FIG. 1A is an enlarged diagram showing the grain orientation of region IA of the third step in this process as represented in FIG. 1.
Figure 1B:
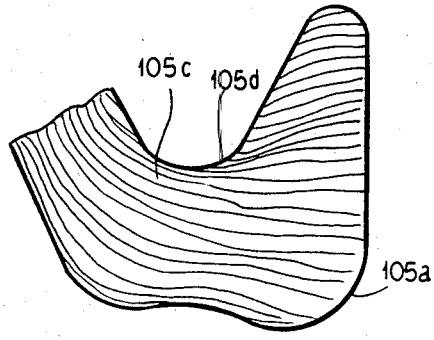
FIG. 1B is a similar diagram showing the region IB of the fifth step in this conventional process.

This upsetting operation in the fourth step is followed by a flattening of the upset portion as shown at 105*a* in FIG. 1 for the blank 105 and in FIG. 1B.

Steps 105–106 continue to represent upsetting operations and at least some of the fibers 105*c* of the microstructure can be seen to develop a perpendicularity to the inwardly depressed portions 105*d* which ultimately will form a bend 111*a*.

Steps 107–108 represent incipient folding steps which preceded the actual hot folding operation which is completed in step 111 by folding a surface of the blank at an acute angle to either surface 111*c* thereof, thereby including the angle $\alpha$ of 45° between these surfaces. This last step represents a hot folding operation.

Figure 1C:
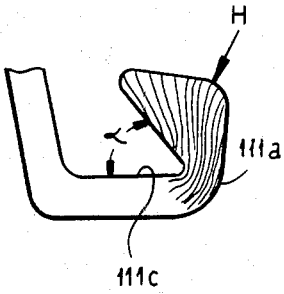
FIG. 1C is a diagram of the region IC of the final step illustrated in FIG. 1.

As is also apparent from FIG. 1C, the fibers in the region of this bend presumably because of the sequence of steps 104 through 108, do not lie strictly parallel to the bend contour.

Furthermore, because of the fiber distortion at the bend, cracks readily appear therein, the hook H is weakened and the defects of the prior-art sheet piling, as described above, are manifested.

By contrast with this system, the bulge 203*a*, formed on the flange of the blank from the third step, is not subjected to an upsetting operation but rather is flat rolled in at least one succeeding step, e.g. the step 204 in which the flattened edge portion 204*a* is readily apparent and preferably in three succeeding rolling passes, namely the passes 204, 205 and 206.

The flat rolling in the latter pass can change the inclination of the edge formation 206*a* to the flange so that an incipient bend can be generated.

Figure 2:
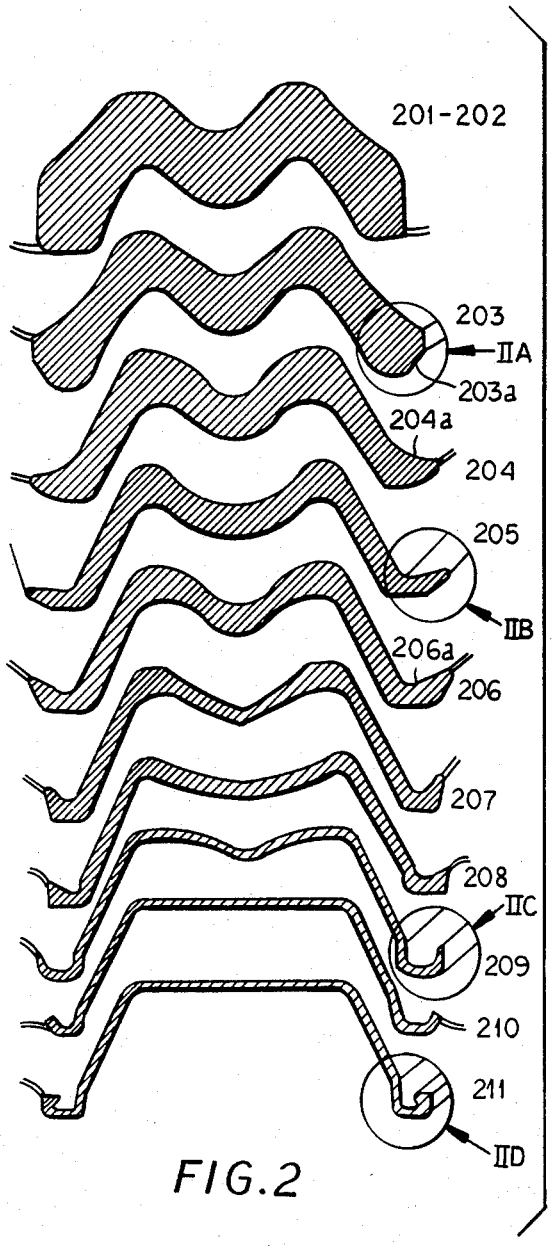
FIG. 2 is a diagram showing ten of the eleven steps of a rolling scheme according to the invention.
Figure 2A:
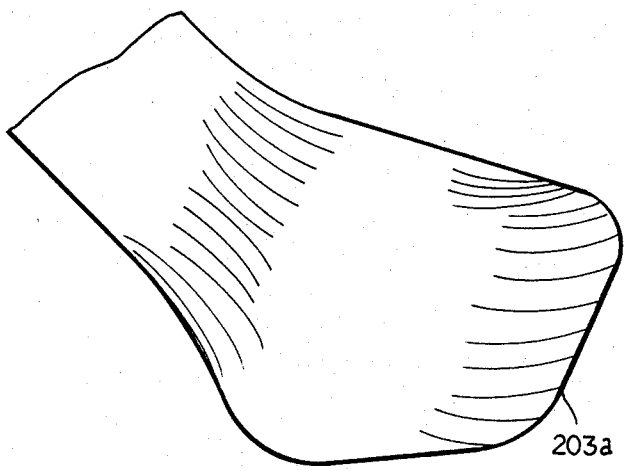
FIG. 2A is a diagram, drawn to an enlarged scale and representing a cross section of the region IIA of the sheet pile blank from the third step of FIG. 2 and illustrating the grain pattern.
Figure 2B:
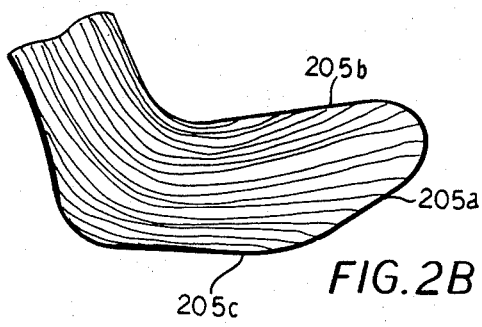
FIG. 2B is a grain pattern diagram of the region IIB from the fifth step of FIG. 2.

As has been shown for the edge portion 205*a* (FIG. 2B) this additional flat or compression working of the edge to be bent into the hook, causes the grain structure to lie substantially uniformly parallel to the surfaces 205*b* and 205*c*, the fold being ultimately effected at an intermediate location of the surface 205*b*.

Figure 2C:
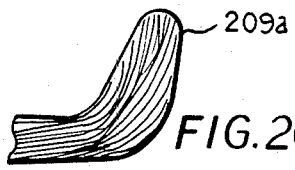
FIG. 2C shows the pattern at IIC of FIG. 2.
Figure 2D:
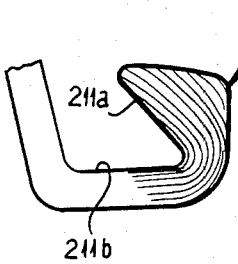
FIG. 2D is a diagram of a grain pattern from the final step in the region IID of FIG. 2.

The effect of this is even more apparent from the detail of FIG. 2*c* wherein folding has already commenced to provide an upturned edge portion 209*a* with the fibers nevertheless uniformly following the surface contour.

When this portion is bent inwardly to form the housing H′ with its surface 211*a* including an angle of 45° with the surface 211*b*, by hot folding, pinching of the fibers does not occur and indeed stress cracking or the like is precluded. By avoiding, therefore, the upsetting operations immediately following the rough rolling of the blank and effecting at least one and preferably three flat working passes before folding or upsetting, the problem of the prior art system can be effectively eliminated.

Where reference has been made herein to flat rolling of the edge portion of a flange or a bulge thereof, it should be understood that this expression is intended to indicate a rolling between two generally cylindrical surfaces, free from ridges, such that the pressure applied in the rolling operation is uniform over the entire area of contact between the rolling surfaces and the rolled bulge so that any deformation of the rolled bulge is effected exclusively by squeezing parallel to this rolling surface.

I claim:

1. In a method of rolling inertial sheet piling in which a generally U-shaped sheet pile is formed with a pair of flanges joining a web and each of the flanges has a hook-shaped extremity, said method comprising three initial rolling passes for roughing a blank such that a bulge is formed at a free edge of each flange, and in three final rolling passes the hook shape is imparted to each extremity by folding, the improvement which comprises:

flat rolling each bulge between substantially parallel generally cylindrical ridge-free rolling surfaces in at least one pass following the formation thereof and without prior upsetting of said bulge whereby a grain structure parallel to the flat rolled bulge is formed prior to the folding passes.

2. The improvement defined in claim 1, further comprising flat rolling the bulge in three successive rolling passes prior to any upsetting of the bulge and prior to folding of the hook-shaped extremity.

3. The improvement defined in claim 2 wherein the last flat rolling pass is carried out to an incipient bend to an edge of each flange adapted to form the housing-shaped portion thereof.

4. The improvement defined in claim 1, claim 2 or claim 3 which comprises forming said hook-shaped extremity by at least one upsetting pass following the flat rolling passes.

5. The improvement defined in claim 3 wherein said hook-shaped edge is formed by hot bending a flat rolled surface of said bulge to include a 45° angle.

* * * * *